United States Patent [19]

Bourdo

[11] Patent Number: 5,066,353

[45] Date of Patent: Nov. 19, 1991

[54] RETAINING WALL EMPLOYING FIBERGLASS PANELS FOR PREVENTING EROSION OF A SHORELINE AND METHOD FOR FABRICATING THE SAME

[75] Inventor: John L. Bourdo, Phoenix, Ariz.

[73] Assignee: Durashore, Inc., Phoenix, Ariz.

[21] Appl. No.: 586,244

[22] Filed: Sep. 21, 1990

[51] Int. Cl.[5] ..... B32B 1/10; E02D 5/02

[52] U.S. Cl. ..... 156/300; 156/306.9; 156/307.7; 264/250; 264/254; 264/274; 264/277; 405/274; 405/284

[58] Field of Search ..... 156/299, 300, 91, 307.7, 156/306.9; 405/274, 284, 31; 264/250, 254, 274, 277

[56] References Cited

U.S. PATENT DOCUMENTS

| | | | |
|---|---|---|---|
| 2,393,429 | 1/1946 | Swinehart | 156/299 |
| 2,438,615 | 3/1948 | Morin | 156/299 |
| 2,829,081 | 4/1958 | Sweem | 156/300 |
| 4,303,707 | 12/1981 | Prior | 427/397 |
| 4,690,588 | 9/1987 | Berger | 405/274 |

*Primary Examiner*—Jan H. Silbaugh
*Assistant Examiner*—Brian J. Eastley
*Attorney, Agent, or Firm*—Don J. Flickinger; Jordan M. Meschkow

[57] ABSTRACT

A shoreline erosion prevention bulkhead system which employs a series of interlocking fiberglass panels. Each panel has elongated male and female interlocking elements extending along the opposite side edges such that, by introducing one end of the male interlocking element of a first panel into one end of a female interlocking element of an adjacent panel and sliding the interlocking elements together, a secure panel joint is achieved. In one presently preferred embodiment, the interlocking portions are generally cylindrical; however, other configurations for the interlocking portions are also included. A process for manufacturing the bulkhead panels includes the steps of emplacing a first layer of a fiberglass and curable resin mixture into a suitable support medium such as a mold, positioning the male and female interlocking elements along opposing sides, emplacing a second layer of the fiberglass and resin mixture over the first layer to capture tail portions of the interlocking units and then allowing the assembly to cure. The tail portions of the interlocking units may have serrated surfaces and/or a series of spaced apart apertures such that the fiberglass and resin layers are allowed to settle into the serrations and through the apertures during the emplacing and curing steps to more securely anchor the interlocking units.

3 Claims, 2 Drawing Sheets

RETAINING WALL EMPLOYING FIBERGLASS PANELS FOR PREVENTING EROSION OF A SHORELINE AND METHOD FOR FABRICATING THE SAME

FIELD OF THE INVENTION

This invention relates to the art of shoreline erosion prevention and, more particularly, to a bulkhead employing interlocking fiberglass panels.

BACKGROUND OF THE INVENTION

In order to prevent the erosion of existing shorelines (and, in some instances, to recover lost shorelines) situated on ocean fronts, lakes and rivers, retaining walls, called bulkheads in the industry, have been erected at the shoreline or the sought after shoreline to control the effect of the encroaching water. In the past, such bulkheads have been made of asbestos cement, concrete, wood, steel or metal alloy, and, most recently, aluminum panels. All these prior art bulkhead materials and the bulkheads fabricated from them have drawbacks which are well known in the art. For example, asbestos cement, concrete and wood crack under stress or impact. Wood tends to rot over a period of time, and steel (and its alloys) rusts. The steel and aluminum panels bend or dent upon impact and are seriously subject to corrosion, particularly in those environments in which salt water is found. The installation of bulkheads consisting of metal panels is difficult and somewhat dangerous due to the necessity to handle the panels with their inherently sharp edges. Bulkheads made of all the foregoing materials are expensive to fabricate and install, and, in the case of the metal panels, a further difficulty is experienced in maintaining the integrity of the joints between adjacent panels.

The present invention is directed to systematically addressing and overcoming all these problems well known to the prior art bulkheads.

OBJECTS OF THE INVENTION

It is therefore a broad object of this invention to provide an improved bulkhead system for protecting shorelines from erosion.

It is another object of this invention to provide such a system in which the components are relatively inexpensive to fabricate and simple and safe to install.

It is still another object of this invention to provide such a system which, in operation, is not subject to corrosion and which readily fends off the effects of impact without cracking or becoming dented or marred.

In a more specific aspect, it is an object of this invention to provide a bulkhead composed of a series of interlocking fiberglass panels and which includes specially configured, mating interlocking elements on respective side edges of adjacent panels to assure the long term integrity of the interlocking joints.

In another, but related, aspect, it is an object of this invention to provide a method for fabricating the individual panels of such a fiberglass bulkhead system.

SUMMARY OF THE INVENTION

Briefly, these and other objects of this invention are achieved by a bulkhead system which employs a series of interlocking fiberglass panels, each of which has an elongated male interlocking element extending along the length of a first side edge and an elongated female interlocking element extending along the length of a second side edge such that, by introducing one end of the male interlocking element of a first panel into one end of a female interlocking element of an adjacent panel and sliding the interlocking elements together, a panel joint is achieved in which joined panels cannot be separated except by reversing the coupling process. In one presently preferred embodiment, the male interlocking element has an interlocking portion with a generally cylindrical outer surface and the female interlocking element has an interlocking portion with a generally cylindrical inner surface with the respective dimensions of the cylindrical surfaces being selected such that the male interlocking portion is slideably and closely received into the female portion by coaxial movement between the interlocking portions. Other configurations for the interlocking portions are also contemplated, disclosed and discussed below. The process for manufacturing the individual bulkhead panels is also disclosed and includes the step of emplacing a first layer of a fiberglass and curable resin mixture into a suitable support medium such as a mold, positioning an elongated male interlocking element along one edge of the first layer, positioning a female interlocking unit along an opposite edge of the first layer, emplacing a second layer of the fiberglass and curable resin mixture over the first layer and in alignment therewith to thereby capture tail portions of the male and female interlocking units and then allowing the assembly to cure. The tail portions of the interlocking units may have serrated surfaces and/or a series of spaced apart apertures such that the fiberglass and resin layers are allowed to settle into the serrations and through the apertures during the emplacing and curing steps to more securely anchor the interlocking units.

BRIEF DESCRIPTION OF THE DRAWINGS

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

DETAILED DESCRIPTION OF THE PREFERRED EMBODIMENT

Figure 1:
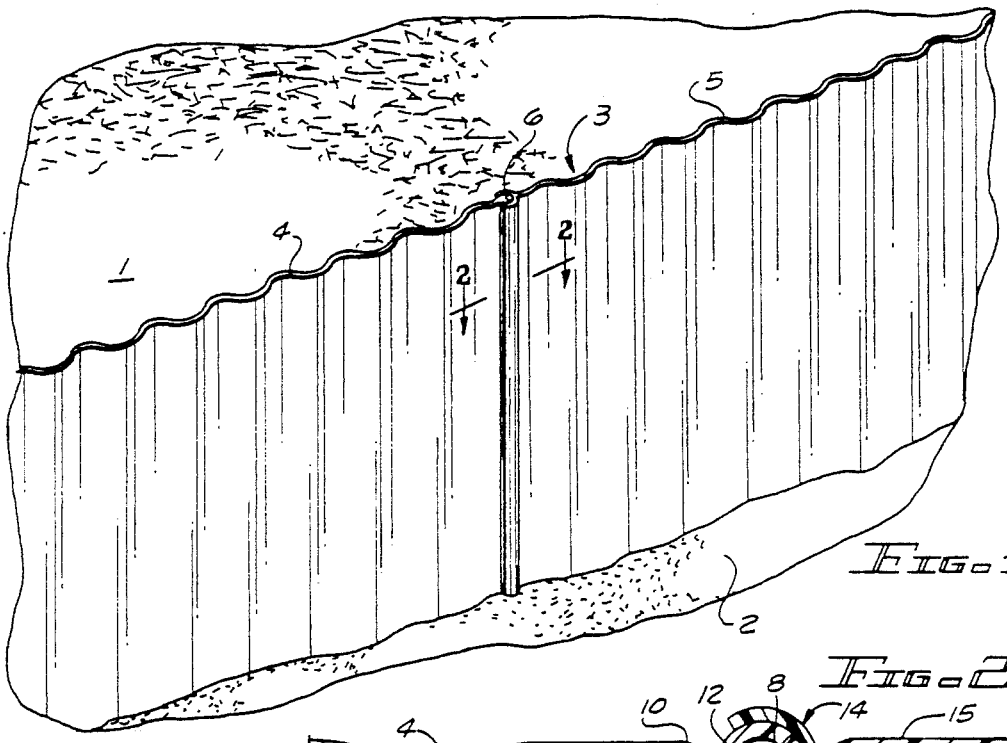
FIG. 1 depicts a section of a fiberglass bulkhead according to the present invention emplaced at a shoreline.

Referring now to FIG. 1, there is shown an exemplary environment for employing the subject invention at a shoreline to be protected which is represented by the high ground 1 abutting a beach 2. A section of a bulkhead system 3 according to the present invention is shown in place and includes first and second adjacent panels 4, 5 coupled at an interlocking joint region 6. It will be appreciated that the bulkhead system 3 can extend as far as necessary in each direction and that a typical system is made up of a number of panels each joined to an adjacent panel by a joint region corresponding to the interlocking joint region 6.

Figure 2:
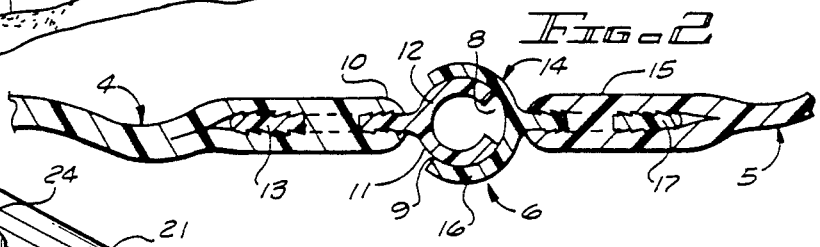
FIG. 2 is a cross sectional view taken along the lines 2—2 of FIG. 1 and particularly showing the configuration of a presently preferred interlocking joint between adjacent panels.

FIG. 2 is a cross sectional view illustrating a presently preferred configuration for the interlocking joint region 6. More particularly, a first side edge 10 of panel 4 carries an elongated male interlocking unit 11 which is particularly characterized by a male interlocking portion 12 extending outwardly from the first side edge 10 of the first panel 4 and a tail portion 13 captured and anchored within the panel 4 in the region immediately adjacent the first edge 10. Similarly, the second panel 5 carries an elongated female interlocking unit 14 along a second side edge 15 (the panels 4, 5 being deemed essentially identical), and the female interlocking unit 14 includes a female interlocking portion 16 and a tail portion 17 which is captured within the panel 5 in the region adjacent the second edge 15 of the panel 5.

As will be described more fully below, the male interlocking portion 12 has a generally cylindrical outer surface (preferably with an open arc region 8) and the female interlocking portion 16 has a generally cylindrical inner surface (preferably with and open arc region 9), and the respective dimensions of the cylindrical surfaces are selected such that the male interlocking portion 12 is slideably and closely receivable into the female interlocking portion by coaxial movement therebetween.

Figure 3:
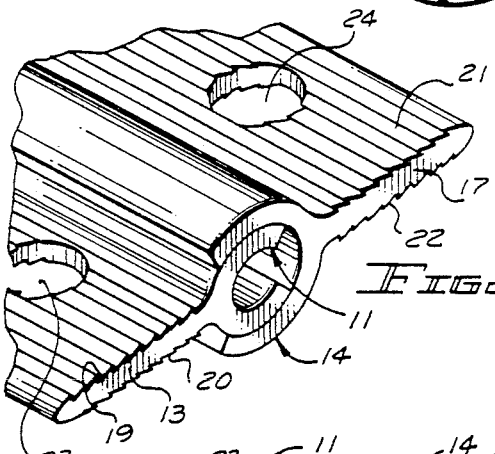
FIG. 3 is a partial perspective view illustrating the interlocking relationship between male and female interlocking units prior to their incorporation into the fiberglass panels during the process of manufacture.
Figure 4:
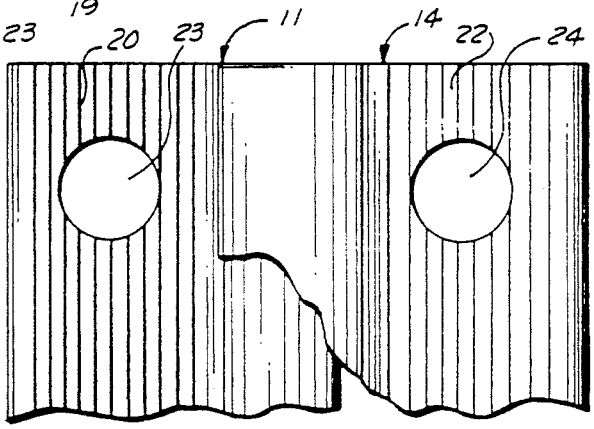
FIG. 4 is a partial plan view of the interlocking units illustrated in FIG. 3.

It is particularly important, considering the heavy requirements placed on a bulkhead performing its intended function, that male and female interlocking units 11, 14 be both very strong and very securely captured within and anchored by the panels with which they are integrated. The manner in which these conditions are satisfactorily achieved may best be understood by first referring to FIGS. 3 and 4. More particularly, each of the tail portions 13, 17 which are to be embedded into the fiberglass panels (as will be described more fully below) include serrated upper and lower surfaces 19, 20 and 21, 22, respectively. Preferably, the elongated tail portions 13, 17 of the interlocking units 11, 14 also include a series of spaced apart apertures 23, 24 provided at intervals along the length of each tail portion. The reason for these apertures, which supplement the effect of the serrations, will be discussed below. It will be observed that each of the male and female interlocking units 11, 12 is in the form of an elongated module extending along the entire length of the respective edge of the panel with which it is integrated. Those skilled in the art will appreciate that such modules can be readily extruded from tough and strong thermoplastics such as those commonly known as PVC and ABS.

Consider now a presently preferred method for preparing fiberglass bulkhead panels according to the present invention. It will again be understood that each panel (such as the adjoining panels 4, 5 in FIG. 1) include a top edge, a bottom edge, a first side edge (along which the male interlocking units are integrated), a second side edge (along which the female interlocking units are integrated), a first face and a second face. However, the manner in which the male and the female interlocking units are incorporated into the panels during the process of manufacture is identical, and therefore only an exemplary female interlocking element is depicted during the process of manufacture illustrated in FIGS. 5*a*, 5*b*, 5*c*, and 5*d*.

Figure 5A:
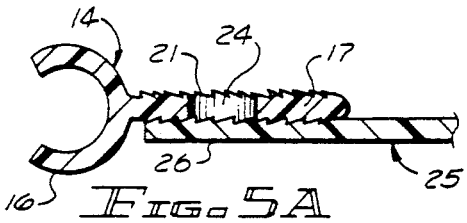
FIGS. 5*a*–5*d* illustrate four sequential steps during the process of manufacture of a fiberglass bulkhead panel according to the present invention.

Thus, referring first to FIG. 5*a*, a first layer 25 of a fiberglass and curable resin mixture is emplaced on any suitable temporary support structure, not shown, such as a mold in the desired panel shape; i.e., appropriate to produce a panel having top, bottom and first and second side edges as well as upper and lower faces. An appropriate composition for the fiberglass reinforced polyester mixture is 25% fiberglass and 75% resin. After the layer 25 has been deposited, the elongated female interlocking unit 14 is laid over the second edge 26 of the fiberglass and curable resin layer 25 with its tail portion 17 directly overlaying the layer 25 and its interlocking portion 16 disposed outboard the second edge 26. During the process of manufacture, it will be understood that a male interlocking unit is similarly laid over a first edge (out of view in FIG. 5*a*) of the layer 25 such that the opposite side edges of each completed fiberglass panel carry, respectively, male and female interlocking units.

Figure 5B:
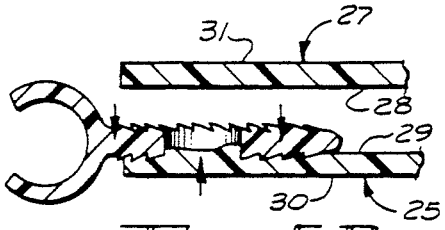
Figure 5C:
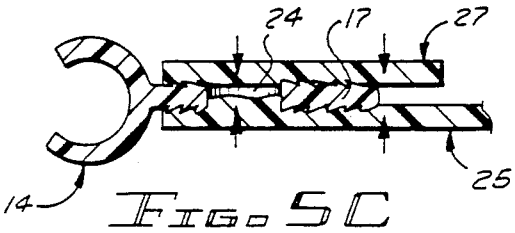
Figure 5D:
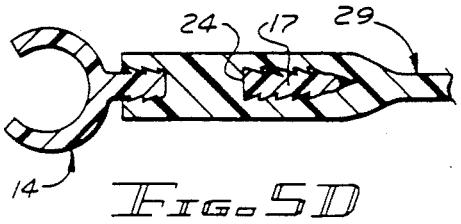

Next, as shown in FIG. 5*b*, a second layer 27 of the fiberglass and curable resin mixture is emplaced in alignment over the first layer 25 such that the respective first and second side edges, tops and bottom edges of the layer 25, 27 are juxtaposed and the second or bottom face 28 of the second sheet 27 merges with the first or upper face 29 of sheet 25 leaving the first or lower face 30 of the first sheet 25 and the second or upper face 31 of the second sheet 27 directed outwardly. In FIG. 5*c*, the layers 25, 27 are shown at the instant they are brought together, and it will be observed that, because of the uncured state of the resin in the layers 25, 27, they are sufficiently fluid as to admit encroachment into the aperture 24 and the serrations of the tail portion 17 of the female interlocking unit 14. As shown in FIG. 5*d*, when the layers 25 and 27 have essentially merged and cured, a unitary fiberglass panel assembly has been realized in which the female interlocking unit 14 is very strongly captured within the resulting panel along its second edge, the fiberglass and resin mixture having completely filled the apertures 24 and the serrations of the tail portion 17 to achieve a very strong integration of the interlocking unit 14 with the resultant fiberglass panel 29. Again, it will be understood that parallel steps to incorporate a male interlocking unit along the side edge out of view in FIGS. 5*a*, 5*b*, 5*c* and 5*d* are performed in an identical manner.

Figure 6A:
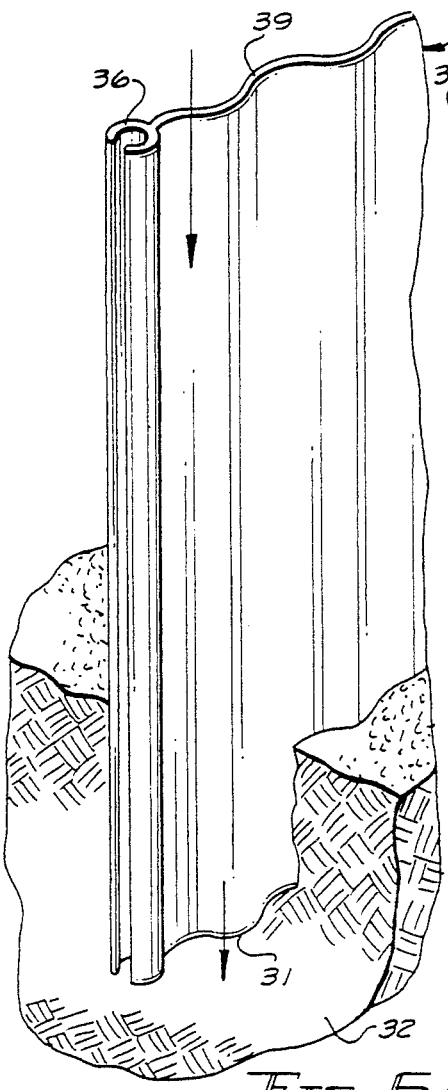
FIGS. 6*a*, 6*b*, and 6*c* illustrate sequential steps in the installation process of a bulkhead emplaced by employing a series of interlocking fiberglass bulkhead panels according to the present invention.
Figure 6B:
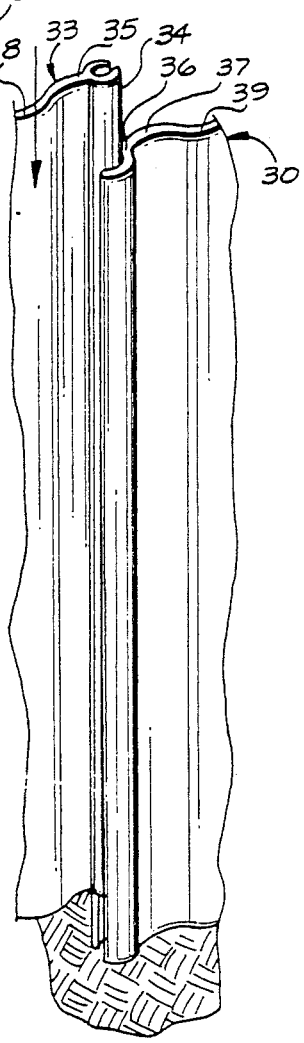
Figure 6C:
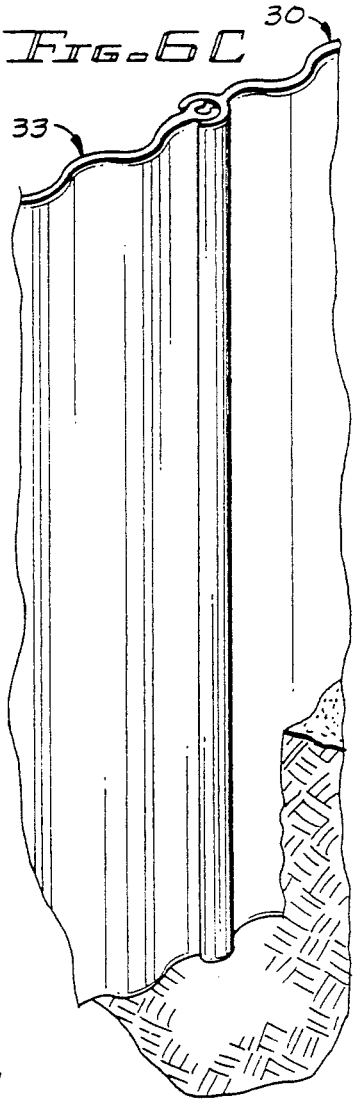

The resulting panel 29 (which corresponds to the panels 4,5 shown in FIG. 1) is strong, relatively lightweight, essential impervious to the deleterious effects of the environment and may be easily handled and installed by interlocking it with identical adjacent panels. Thus, referring more particularly to FIGS. 6*a*, 6*b* and 6*c*, a first panel 30 may be emplaced by driving its bottom edge 31 into the terrain 32. When the first panel has been installed, a second panel 33 is emplaced by introducing its male interlocking element 34 lying along its first edge 35 into the female interlocking element 36 lying along the second edge 37 of the first panel 30. The second panel 33 is then driven downwardly until its top edge 38 is even with the top edge 39 of the first sheet 30, all as depicted in FIG. 6c. Subsequently, yet another panel adjacent the panel 33 may be installed in the identical manner, and the process continued until the entire bulkhead system has been installed. Thereafter, because of the configuration of the interlocking elements 34, 36, the panels cannot be decoupled in any direction excepting by withdrawing them coaxially in the reverse process of the assembly step. That is, the interlocking joint is constrained against any sort of pulling apart by the interlocking characteristics of the joint between the adjacent panels while nonetheless a slight circumferential motion is admissible for absorbing various forces which may impinge upon the panels.

Figure 7:
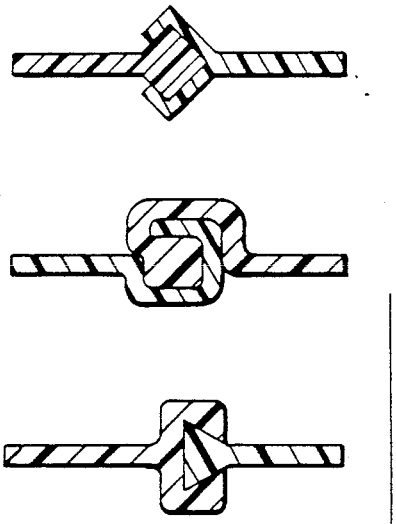
FIG. 7 illustrates three variant configurations in cross section of coupled male and female interlocking units which may be employed in the present invention.

It is for this last reason and for its relative ease of manufacture by, for example, extrusion, that the cylindrical interlocking portion shape is especially well suited to the present application. However, other interlocking configurations may also be employed, and a few of these alternative configurations are illustrated in FIG. 7 in which the interlocking components are generally diamond-shaped (upper figure), rectangular in cross section (middle figure) and triangular in cross section (lower figure).

Thus, while the principles of the invention have now been made clear in an illustrative embodiment, there will be immediately obvious to those skilled in the art many modifications of structure, arrangements, proportions, the elements, materials, and components, used in the practice of the invention which are particularly adapted for specific environments and operating requirements without departing from those principles.

What is claimed is;

1. A process of manufacture for a bulkhead retaining wall panel including the steps of:

a) emplacing a first layer constituting a mixture of fiberglass and curable resin on a support medium, said first layer, when emplaced, having a top edge boundary; a bottom edge boundary; a first side edge boundary; a second side edge boundary; a first face; and a second face;

b) positioning an elongated male interlocking unit along said first side edge boundary of said first layer, said male interlocking unit being characterized by a cross sectional shape which includes a male interlocking portion and a tail portion, said male interlocking unit being positioned such that only its tail portion overlays said first face of said first layer;

c) positioning an elongated female interlocking unit along said second side edge boundary of said first layer, said female interlocking unit being characterized by a cross sectional shape which includes a female interlocking portion and a tail portion, said female interlocking unit being positioned such that only its tail portion overlays said first face of said first layer; claim 5 cont.

d) emplacing a second layer constituting a mixture of fiberglass and curable resin over said first layer, said second layer having a top edge boundary; a bottom edge boundary; a first side edge boundary; a second side edge boundary; a first face; a second face; and substantially the same dimensions as said first layer; such that said top, bottom and first and second side edge boundaries of each said layer are coextensive with said second face of said second layer overlaying said first face of said first layer whereby the tail portions of said male and female interlocking units are captured therebetween; and e) allowing the assembly effected during steps A), B), C) and D) to cure.

2.) The process of claim 1 in which said tail portion of said male and female interlocking units have serrated surfaces and said fiberglass and resin layers are allowed to settle into the serrations during the depositing and curing steps to securely anchor said interlocking units.

3.) The process of claim 2 in which said tail portions of said male and female interlocking units each further include a series of spaced apart apertures into which said fiberglass layers are allowed to settle and merge during the depositing and curing steps to more securely anchor said interlocking units.

* * * * *